United States Patent [19]

Rose et al.

[11] 3,978,598

[45] Sept. 7, 1976

[54] APPARATUS FOR SIMULATING AN OPEN FIRE

[76] Inventors: Bernard R. Rose, 933 Airole Way, Bel Air, Calif. 90024; Daniel H. Meggs, 4313 Vista Largo; Janos Beny, 4445 Pacific Coast Highway, both of Torrance, Calif. 90505

[22] Filed: Jan. 16, 1975

[21] Appl. No.: 541,605

[52] U.S. Cl. ..... 40/106.52; 272/8 F

[51] Int. Cl.[2] ..... G09F 13/36

[58] Field of Search ..... 40/106.52–106.54, 40/126 B, 139, 138; 272/8 F, 10; 240/10 R, 10.1, 90

[56] References Cited

UNITED STATES PATENTS

| | | | |
|---|---|---|---|
| 1,572,836 | 2/1926 | Berry | 40/106.54 |
| 1,586,597 | 6/1926 | Berry | 40/106.54 X |
| 1,901,294 | 3/1933 | Gritt et al. | 40/106.54 |
| 2,173,939 | 9/1939 | Hall | 40/106.52 |
| 3,526,984 | 9/1970 | Nielsen et al. | 40/106.52 |
| 3,531,636 | 9/1970 | Birch | 240/10.1 |
| 3,639,749 | 2/1972 | Beckman | 240/90 |
| 3,742,189 | 6/1973 | Conroy et al. | 40/106.54 X |
| 3,868,501 | 2/1975 | Barbour | 240/10 R X |

FOREIGN PATENTS OR APPLICATIONS

| | | | |
|---|---|---|---|
| 414,280 | 8/1934 | United Kingdom | 40/106.52 |
| 348,349 | 5/1931 | United Kingdom | 40/106.52 |

*Primary Examiner*—John F. Pitrelli
*Attorney, Agent, or Firm*—Herzig & Walsh, Incorporated

[57] ABSTRACT

Apparatus for simulating an open fire having a lamp mounted on a base structure within a shell. The shell is simulative of a pile of burning logs or the like and is at least in part light transmitting. Light masks are included, one of which operates to project the image of a flame on a projection screen mounted at the rear of the apparatus base. Arrangements may also be included for varying the light pattern projected from the lamp, for simulating the heat of a fire and for simulating the burning noise of a fire.

9 Claims, 7 Drawing Figures

FIG. 3
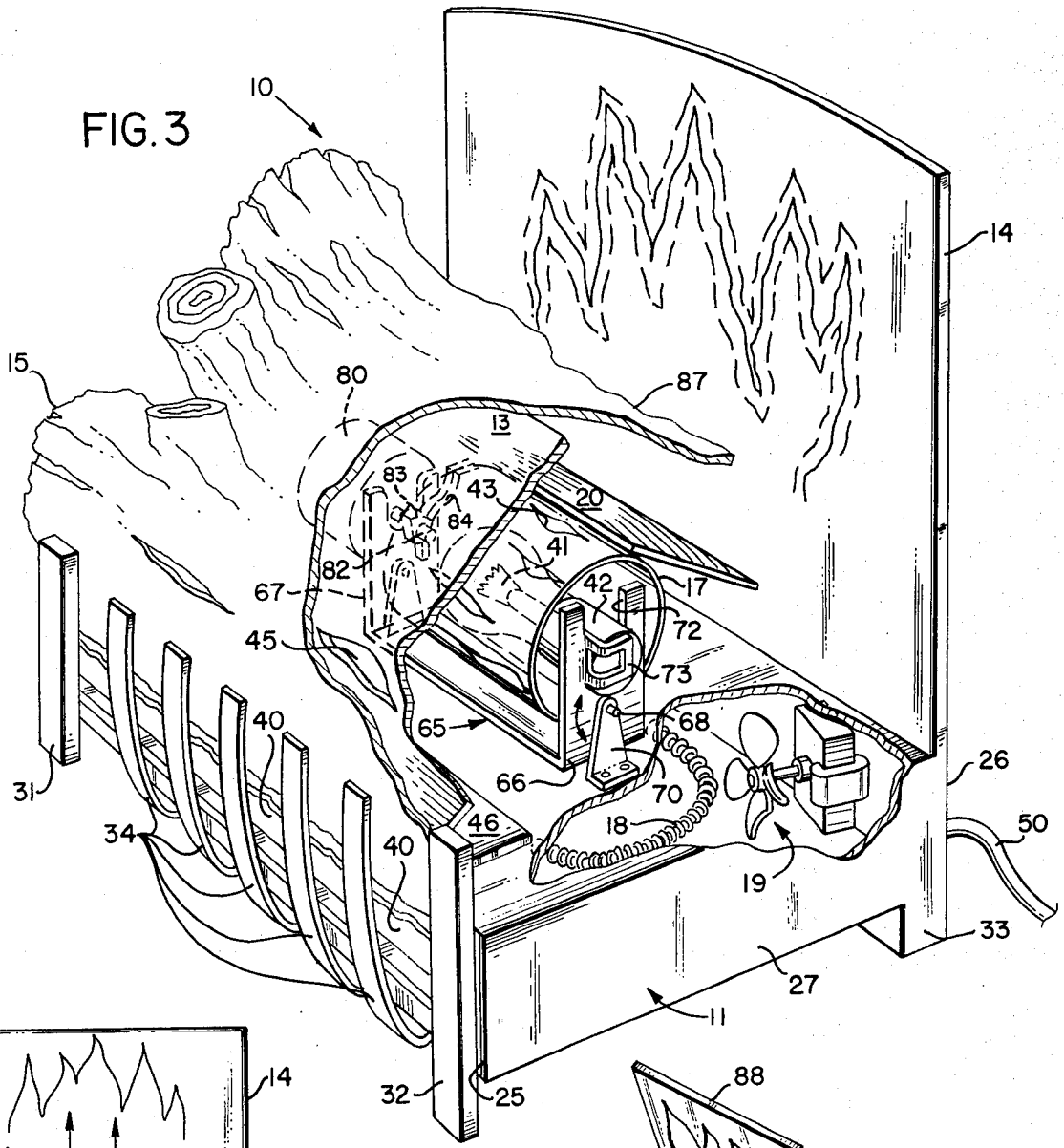
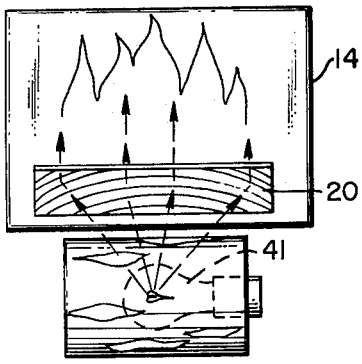
FIG. 5
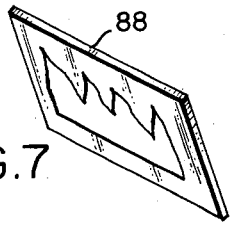
FIG. 7
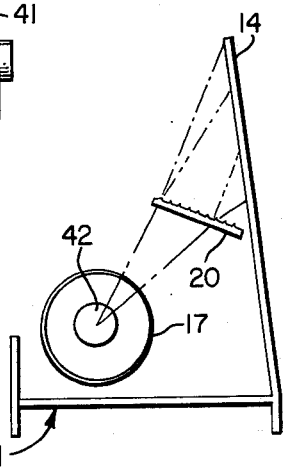
FIG. 6
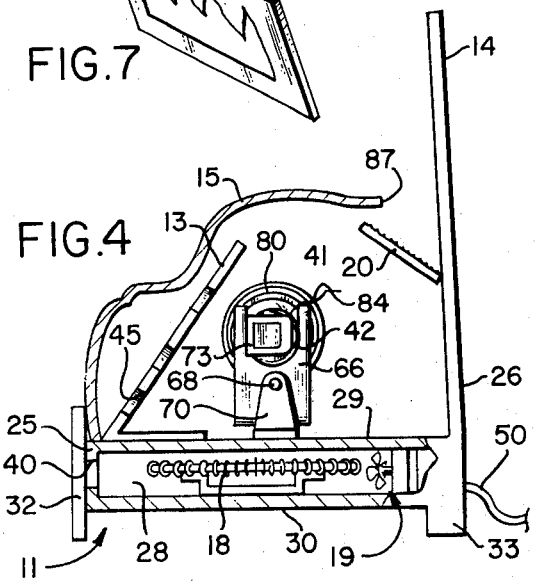
FIG. 4

APPARATUS FOR SIMULATING AN OPEN FIRE

BACKGROUND OF THE INVENTION

The present invention relates to an improved apparatus for simulating an open fire.

SUMMARY OF THE INVENTION

It is an object of the present invention to provide an improved apparatus capable of simulating an open fire by having one or more of the following features: capable of giving the appearance of a pile of burning logs or the like; capable of forming the image of flames; capable of producing a light pattern, which may be varying, having the appearance of an open fire; capable of simulating the heat of an open fire; and capable of simulating the noise of a burning fire.

In accomplishing these and other objects, there is provided apparatus having a lamp mounted on base structure within a shell. The shell is simulative of a pile of burning logs or the like and is at least in part light transmitting. Light masks are included, one of which operates to project the image of a flame on a projection screen mounted at the rear of the apparatus base. Means may also be included for varying the light pattern projected from the lamp, for simulating the heat of a fire and for simulating the burning noise of a fire.

Additional objects of the present invention reside in the specific construction of the apparatus hereinafter shown in the drawings and described in conjunction therewith.

BRIEF DESCRIPTION OF THE DRAWINGS

FIG. 3 is an isometric schematic view of a modified form of the invention.

FIG. 4 is an end view of FIG. 3.

FIGS. 5 and 6 detail schematic views of the relationship between the Fresnel lens and the light source.

FIG. 7 is an isometric view of a transparency bearing an image of flames.

DETAILED DESCRIPTION OF THE PREFERRED EMBODIMENT

Figure 1:
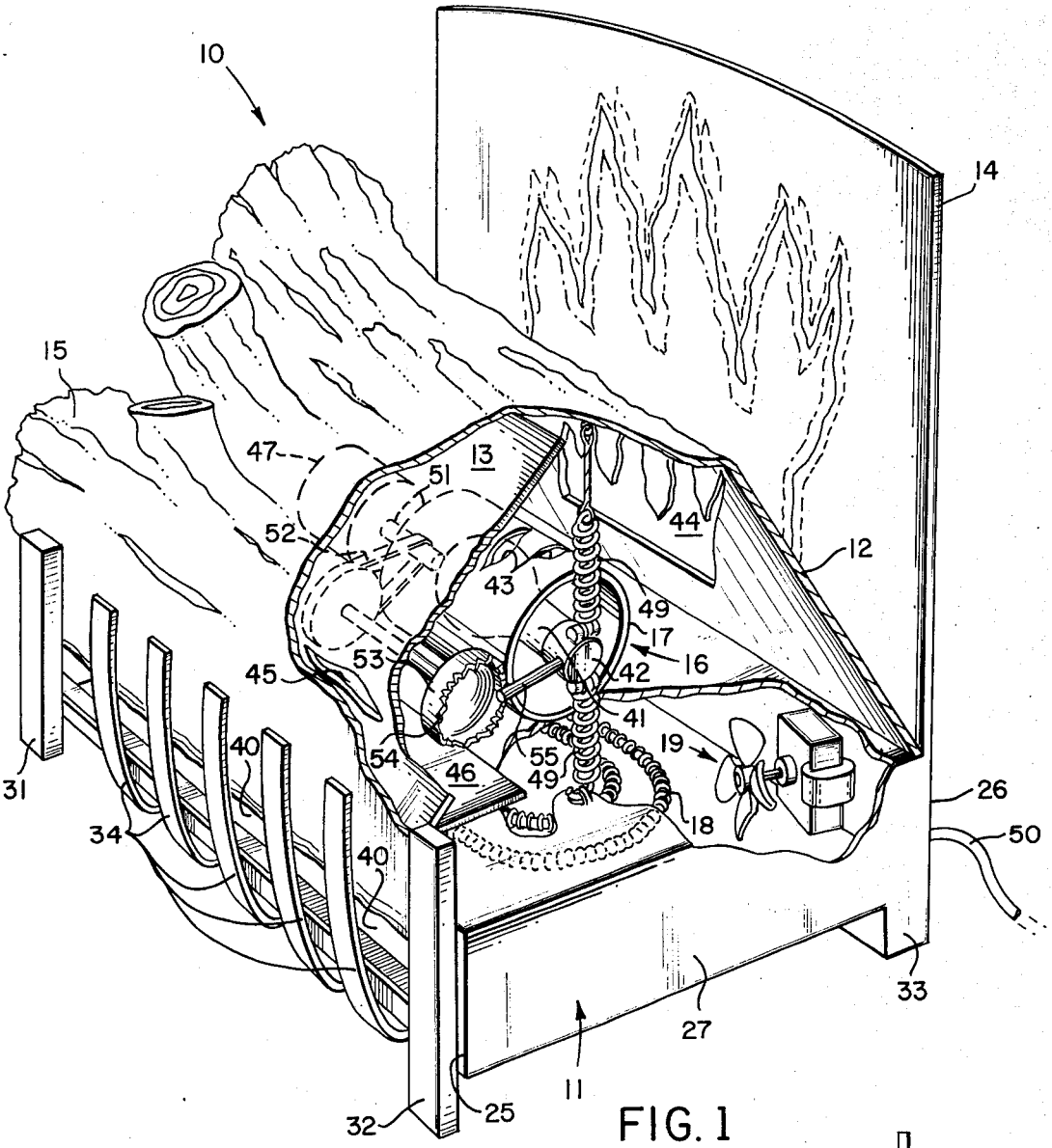
FIG. 1 is a perspective view of an apparatus, according to the present invention, for simulating an open fire.

Referring to the drawings in more detail, there is shown an apparatus for simulating an open fire generally identified by the numeral 10. The apparatus 10 illustrated is appropriately dimensioned for placing in a fireplace and has base structure 11, a flame mask 12, a log mask 13, a projection screen 14, shell structure 15, lamp means 16 including a rotating drum arrangement 17, a heating element 18 and a fan 19.

The base structure 11 shown is preferably a hollow rectangular cavity defined by front wall 25; rear wall 26; side walls 27, 28; top wall 29; and bottom wall 30. The rectangular hollow base structure defined by the walls 25–30 is supported at its front corners by legs 31, 32 and along its rear edge by leg structure 33. Secured to the base structure 11 to extend upwardly at the front thereof between the legs 31 and 32 are members 34. The members 34 in conjunction with the legs 31 give the appearance of the front of a fireplace cradle for holding wood to be burned.

Mounted within the hollow base defined by the walls 25–30 is the electrical heater element 18 and the fan 19. The heater element 18 and fan 19 operate together to provide means for simulating the heat of a burning fire. The fan 19 circulates the heat generated by the heater element 18 by blowing it out the vent openings 40 illustrated formed in the front wall 25.

Mounted to extend upwardly from the rear edge of the base 11 is the projection screen 14. The screen 14 preferably is an arcuate surface which curves about a vertically extending axis. Mounted adjacent the rear edge of the base 11 to slope upwardly and forwardly therefrom is the planar flame mask 12. The flame mask 12 has a cutout 44 therein shaped in the image of a flame.

Extending from the upper edge of the flame mask 12 to the front edge of the base 11 is the shell structure 15. The shell structure 15 is illustrated formed like a stack of logs to give realistic appearance and is made at least in part light transmitting to permit glow to show through. A partially light transmitting shell structure 15 may be made in any of several ways, such as by using transparent material which has been painted to permit light to glow through at desired locations or by making the shell 15 of opaque material with openings formed therein at selected locations.

Mounted on the upper surface of the top wall 29 of the base 11 is the lamp means 16. The lamp means 16 as illustrated is formed by an electrical lamp or bulb 41 inserted in an electrical socket 42. The socket 42 is held by diametrically oppositely extending springs 49 which are shown extending vertically. The upper end of the upper spring 49 is illustrated hooked by hook 48 to the underside of the shell 15 while the lower end of the lower spring 49 is illustrated secured to the base wall 29. The rotating drum 17 is mounted to extend substantially horizontally along the longitudinal axis of the base 11 around the bulb 41. The rotating drum arrangement 17 is driven by a motor 47. Connected to the output shaft 51 of the motor 47 is a pulley 52 which drives a cam arrangement 53. The cam arrangement 53 has an uneven edge 54 which rotates against a rod 55 which extends horizontally from the socket 42. Thereby, rotation of the cam 53 causes the light 41 to vibrate back and forth on the springs 49 to vary the light pattern directed through the drum 17 towards the shell structure 15 and the flame mask 12. The drum 17 is on the shaft of motor 47. It may be made of a rolled strip of vinyl having irregular areas of different color including plain areas of neutral color or transparent. The colors may include yellow, orange and/or other colors to transmit light simulating flickering flames.

There may be in the drum 17 loose pebble or particle like materials which tumble as the drum 17 rotates. The materials of the drum 17 and the particles are selected so that as the particles tumble a crackling noise simulative to the burning of a wood fire is produced. It is noted that this noise simulative of a burning fire could also be produced by making the surface of the drum 17 irregular and rotating it against a fixed surface.

Mounted on the upper surface of the base top 29 ahead of the lamp means 16 to extend upwardly between the lamp means 16 and the shell 15 is the log mask 13. The log mask 13 is illustrated with cutouts 45 formed therein which operate to control the transmission of light to the shell structure 15. It limits the amount and shape of illumination applied to the interior of log surface and creates a glowing log effect.

Positioned on the base top wall 29 alongside of and behind the log mask 13 is a mirror 46. The mirror 46 functions to reflect light from the lamp means 16 through the log mask 13 onto the shell 15. Thereby, illumination of the shell 15 is increased and any waterfall effect on the shell 15 created by the rotation of the drum 17 is minimized.

In operation of the apparatus 10, the electrical cord 50 (shown in part) is connected to receive electricity. The cord 50 is connected in a conventional manner (not shown) to supply electricity to the heater element 18, fan 19, lamp 41 and the motor 48. With the apparatus 10 thus energized, a sound simulative of a burning fire is produced by the tumbling of the loose material in the rotating drum 17; heat simulative of a fire is produced by the heater element 18 and the fan 19; a flickering glowing shell simulative of burning logs or the like is produced by the light radiated from the vibrating lamp 41 through the drum 17 and mask 13 onto the shell 15; and the appearance of a wavering or flickering flame is produced on the screen 14 by the light from the vibrating bulb 41 transmitted through the mask 12 onto the screen 14. The light transmitted through rotor 17 simulates flickering colored flames, which because of the rotor movement appear to move upwardly on screen 14 which may be finished to accentuate brightness and realism by use of metallic paint or flecks on dark background.

It is noted that by making the surface of the screen 14 curved that the tendency of the flame image to appear to radiate from one spot is diminished. Further realism may be accomplished by finishing the screen 14 in a manner which accentuates flame brightness and realism, such as by the use of metallic paint or flecks on a dark background.

Additionally, it is noted that the light masks described herein may be formed as illustrated by use of opaque materials with die-cut openings formed therein or by the use of materials formed or coated to have varying degrees of translucency or color transparency. Also, the rotating drum means 17 instead of being electrically driven could be arranged to be driven by the heat generated by the heating element 18. Also, instead of vibrating the lamp 41, substantially the same effect could be produced by vibrating or animating the flame masks.

Figure 2:
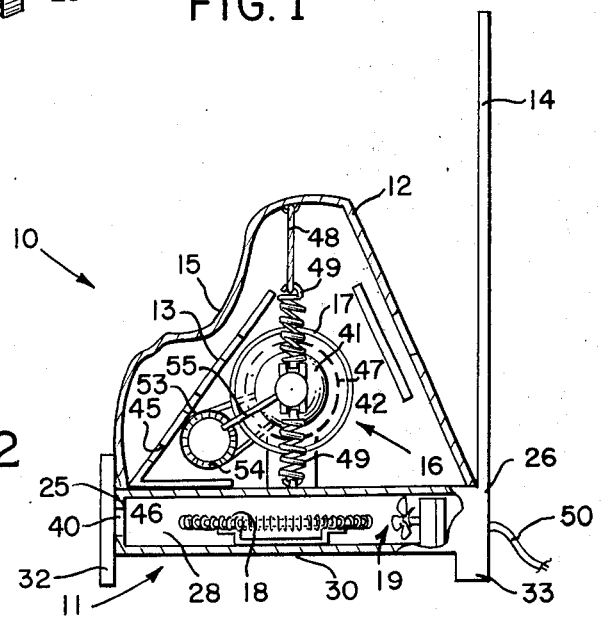
FIG. 2 is a side elevation cross-sectional view of the apparatus of FIG. 1.

FIGS. 3 and 4 show a modified form of the invention utilizing a lamp assembly as illustrated in FIG. 5. Parts that are like those of the previous embodiment are identified by the same reference characters. The lamp and its activating assembly as shown in FIGS. 3 and 4 are mounted on the bottom wall of shell 15 in the position of assembly 16 of FIGS. 1 and 2. Numeral 65 designates a cradle having ends 66 and 67. It is swung on end trunnions, one of which is shown at 68, extending from end support brackets, one of which is designated at 70. Socket 42 carries bulb 41. End member 66 has a cut-out 72 and extending socket support bracket 73 carrying lamp socket 42. Bracket 73 is a flexible leaf spring which allows the lamp to vibrate laterally with respect to the cradle, its natural harmonic vibratory frequency being different than that of the cradle to produce random flickering.

Numeral 80 designates a drive motor carried by end member 67. On its shaft 82 is three lobed cam 83 which engages flexible cam follower arm 84 suitably mounted within shell 15.

In operation the cam 83 engages follower 84 to agitate or vibrate lamp 41 by causing cradle 65 to swing in a generally random way to produce functions and results like those already described. The assembly in FIG. 3 may be otherwise like that of the previous embodiment.

The shell structure 15 extends towards the screen 14 and preferably to it, the shell having a cut-out 87 to permit the flame image to pass up on to the screen 14 as illustrated in FIGS. 4–6. Numeral 20 designates a Fresnel lens positioned as shown to focus the light coming through the rotor 17 and to direct it through the cut-out 87 on to the screen 14 which is tilted at an angle as illustrated. The Fresnel lens has a relatively large radius of curvature relative to its focal length. It collects a relatively large amount of light and focuses it on to the screen as illustrated in FIGS. 5 and 6. The light source and lens are hidden from view. The geometric relationship of the parts is such that the flame image closely simulates actual flames. Preferably associated with the Fresnel lens 20 is a transparency 88, FIG. 7, having a real or a contrived flame image on it which is positioned adjacent to or against one side of the Fresnel lens 20 so that the image is projected. The flame image on the transparency 88 is designed so that the projected image on the screen 14 closely simulates real flames.

As may be observed from the accompanying drawings that the object to be projected, e.g., from the drum 17, and through the lens 20, is greatly enlarged, several fold larger than the object, as an image on the screen 14. This is made possible because the shell 15 is spaced from the screen 14 in such a manner as to provide a relatively small opening thereat, through which said image can be projected and magnified on the screen 14. By this construction, observers of the fireplace do not see the opening at 87-14 and the structure therefore also permits the concealment of the equipment by which the projection of the enlarged image is accomplished, viz., the drum 17 and the objects projected therefrom, the lens 20, the mirror at 46 and other associated parts. As may be observed from FIG. 6, for example, the projected image can be multiple in size of the object on the order, as illustrated, of approximately eight-to-one.

In operation as described above, with the lamp vibrating and the rotor rotating, the colored light passing through the transparency and lens projects the flame image which flickers on the screen 14, and this can be accentuated and greater realism by way of metallic paint or flecks on the dark background of the screen. The different colored areas of the rotor 17 produce light spots which move vertically upwardly on screen 14 contributing to the realistic effect. The transparency 88 itself may be appropriately colored, these colors interacting with the colored light coming through the rotor 17 to further contribute to the realistic effect.

Although the invention has herein been shown and described in what is conceived to be the most practical and preferred embodiment, it is recognized that departures may be made therefrom within the scope of this invention.

We claim:

1. Apparatus for simulating an open fire, comprising:

base structure having a front and rear edge;

a light projection screen mounted on said base structure to extend upwardly from its rear edge;

first mask means mounted on said base structure forwardly of said projection screen, said first mask means having a light transmitting portion therein which defines the image of a flame;

lens means between said first mask means and said screen;

shell structure mounted to extend from the front edge of said base structure, said shell structure being formed to simulate a pile of burning logs or the like and being at least in part light transmitting; and lamp means mounted on said base structure forwardly of said first mask means within said shell structure, said lamp means being operable when illuminated to project light towards said shell structure and said first mask means whereby an enlarged image simulative of a flame is projected through said light transmitting portion of said first mask onto said projection screen and the light transmitted through said shell structure gives said shell structure the appearance of burning material;

second mask means mounted on said base structure and positioned to extend between said lamp means and said shell structure for controlling the transmission of light from said lamp means to said shell structure; and wherein:

said lamp means comprising an electrical lamp and said first mask comprising a rotating drum means positioned therearound and which directs a changing light pattern from said lamp towards said shell structure, said lamp being mounted for swinging movement and motor means for producing the swinging movement.

2. The invention defined in claim 1, including mirror means positioned within said shell structure to reflect onto said shell structure a portion of said light pattern transmitted by said drum means thereby to compensate for any waterfall effect created by the rotation of said drum means.

3. The invention defined in claim 1 including means for generating heat comprising heater means and fan means mounted in said base structure, said fan means being positioned to circulate air heated by said heater means.

4. The invention defined in claim 1 including means for simulating the noise of a burning fire.

5. The invention defined in claim 4 wherein said means for simulating the noise of a burning fire comprises a plurality of loose particles positioned in said which tumble with the rotation of said drum means to produce a sound simulative of a burning fire.

6. The invention defined in claim 1, wherein the surface of said projection screen is curved to give the appearance that the flame image projected onto said projection screen does not originate from a fixed position.

7. Apparatus for simulating an open fire, comprising:

base structure having a front and rear edge;

a light projection screen mounted on said base structure to extend upwardly from its rear edge;

first mask means mounted on said base structure forwardly of said projection screen to extend forwardly and upwardly, said first mask means having a light transmitting portion therein which defines the image of a flame;

lens means between said first mask means and said screen;

shell structure mounted to extend upwardly from the front edge of said base structure and forwardly spaced from said light projection screen so as to provide a relatively small opening between said shell structure and said light projection screen, said shell structure being formed to simulate a pile of burning logs or the like and being at least in part light transmitting; and lamp means mounted on said base structure forwardly of said first mask means within said shell structure, said lamp means being operable when illuminated to project light towards said shell structure and said first mask means whereby an enlarged image simulative of a flame is projected by said lens means through said relatively small opening between said shell structure and said screen onto said projection screen and the light transmitted through said shell structure gives said shell structure the appearance of burning logs or the like.

8. The invention defined in claim 7 including means for generating heat to simulate a burning fire.

9. The invention defined in claim 7, wherein said lamp means includes:

an electrical lamp mounted on support means; and means for vibrating said lamp to vary the pattern of light emanating therefrom.

* * * * *